United States Patent [19]

Menier

[11] 4,101,627

[45] Jul. 18, 1978

[54] METHOD OF FORMING PAPER PRODUCTS

[75] Inventor: Vincent J. Menier, Pepper Pike, Ohio

[73] Assignee: North American Systems, Inc., Bedford Heights, Ohio

[21] Appl. No.: 710,400

[22] Filed: Aug. 2, 1976

[51] Int. Cl.[2] ..... B31D 5/02

[52] U.S. Cl. ..... 264/323; 264/163; 264/292; 264/320

[58] Field of Search ..... 264/322, 292, 163, 235, 264/346, 234, 320, 345, 323; 93/60

[56] References Cited

U.S. PATENT DOCUMENTS

| | | | |
|---|---|---|---|
| 209,686 | 11/1878 | House | 264/323 X |
| 1,645,931 | 10/1927 | Ruckert | 93/60 |
| 2,066,988 | 1/1937 | Lee | 264/322 X |
| 2,120,328 | 6/1938 | Ferngren | 264/292 X |
| 2,952,297 | 9/1960 | Hollis | 264/322 X |
| 3,550,421 | 12/1970 | Stakel | 93/60 X |

*Primary Examiner*—Jan H. Silbaugh

[57] ABSTRACT

Apparatus and method are provided for producing paper products by forming a paper sheet stock into a desired shape, forcing the shaped paper product through a heat-setting tube, and steam heating the shaped paper product sufficiently to maintain its shape upon removal from the heat-setting tube. Maintaining the paper product in its desired shape is accomplished by supplying steam into the interior of the heat-setting tube and into a steam tube surrounding the heat-setting tube. Preferably, superheated steam is employed in the formation of a nested group of shaped paper products, such as coffee filters, which are simultaneously produced from multi-layered paper sheet stock.

3 Claims, 2 Drawing Figures

METHOD OF FORMING PAPER PRODUCTS

BACKGROUND OF THE INVENTION

This invention relates to apparatus and method for producing shaped paper products, such as coffee filters, by mechanically shaping paper sheet stock into the desired form and then steam heat setting the form to maintain its desired shape.

As explained in more detail hereinafter, it has been known to produce shaped paper products by forming paper sheet stock into the desired shape and heating the shaped product in order to maintain the desired form upon removal from the apparatus, the heating being accomplished by air and electric resistance heaters. However, such method and apparatus have numerous problems, especially fire hazards.

Steam has been used in the formation of paper and related products. See U.S. Pat. Nos. 1,431,922 and 2,149,507.

SUMMARY OF THE INVENTION

In accordance with the present invention, a desired paper product is produced in a process and apparatus for forming a paper blank into the desired shape, forcing the shaped paper product through a heat-setting tube, and steam heating the shaped paper products sufficiently to maintain its form upon removal from the heat-setting tube by the introduction of steam into the interior of the heat-setting tube and into a steam tube surrounding the heat-setting tube. Thus, while the paper product is confined within the heat-setting tube, heat is supplied both directly and indirectly by steam to set the paper product into its final form.

Preferably, superheated steam is employed in conjunction with apparatus and method for forming a group of nested paper products, such as coffee filters, from multi-layered paper sheet stock.

BRIEF DESCRIPTION OF DRAWINGS

The advantages of the present invention will become apparent from the following detailed description when considered with the accompanying drawings, in which.

DETAILED DESCRIPTION OF PRIOR ART

Figure 1:
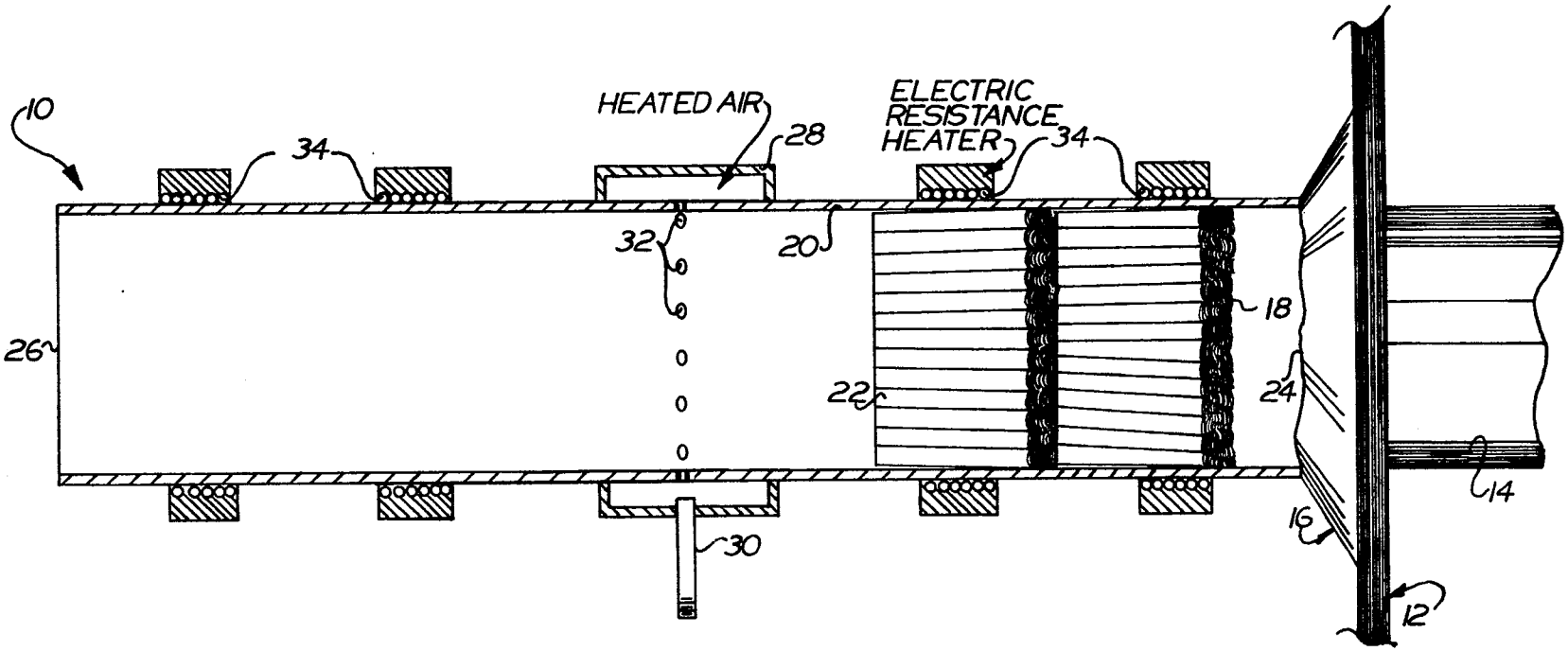
FIG. 1 PRIOR ART
FIG. 1 is a schematic longitudinal view partly in elevation and partly in cross section of prior art apparatus used to form a nested group of filters.

In the prior art apparatus shown in FIG. 1, a converter assembly 10 produces, for example, nested groups of filter papers from multi-layered paper sheet stock 12 which comprises a series of parallel paper sheets simultaneously fed from a series of supply rolls not shown in the accompanying drawings. The multi-layered paper sheet stock 12 is fed between a plunger 14 which cooperates with a die 16 in a reciprocal fashion. For example, if the converter assembly 10 is adapted to form coffee filters for automatic coffee machines, die 16 is constructed to have a circular outer periphery with the interior portion having a fluted or scalloped form in order to produce the well-known shape of coffee filters. The reciprocating plunger 14 moves into the die 16 to simultaneously blank and form the multilayered paper sheet stock 12 into the final desired shape of the paper products shown as a nested group of filters 18. The die and plunger are schematically shown in elevation since they are conventional in form and operation. In one particular type of apparatus the plunger essentially tears the paper sheet stock held against the die outer periphery by a guide and then forces the blanked paper into the assembly.

The plunger 14 forces the nested group of paper products 18 from the die into a heat-setting tube 20 where the paper products are confined into their desired final shape. In turn, a preceding group or groups of paper products 22 is moved forwardly within heat-setting tube 20 by the entry of the group from the die. Only two groups are shown within heat-setting tube 20, but it will be appreciated that the complete length of tube 20 is filled with groups of paper products from the entrance 24 to the outlet 26 where the paper products are removed for packaging.

The function of the heat-setting tube 20 is to maintain the paper product in its desired shape upon removal at the outlet end 26 of the tube 20 by heat setting the paper material while confined to its desired shape within tube 20. In order to accomplish this, heat is supplied to the tube 20 in two ways. First, heated air, preferably heated to a temperature greater than 212° F, is introduced into a manifold 28 surrounding the central portion of the tube 20. Manifold 28 comprises an annular ring surrounding the entire periphery of the tube and having an air supply tube 30 introducing air into the body of the manifold 28, the air thereby being transferred into the interior of the heatsetting tube 20 by a series of holes 32 leading from the body of the manifold 28 into the interior of the tube 20. Second, heat is supplied to substantially the whole length of heat-setting tube 20 by means of a series of electric resistance heaters 34 which are also in the shape of an annular ring surrounding the heat-setting tube 20. The electric resistance heaters 34 transfer heat to the heat-setting tube 20 which then in turn transfers heat into the interior of the tube.

Because of the nature of this arrangement, each electric resistance heater 34 requires 440 volts. As a result of these high voltage electric resistance heaters 34, fires are a frequent occurrence because of blowouts of the resistance wires. The danger to employees is so great that fire extinguishers must be maintained near each converter assembly 10; also, the down time of the machine while the electric resistance heaters 34 are being replaced can cause problems in controlling and meeting production schedules.

Another problem with this prior art apparatus is that the time the paper products spend within the heat-setting tube 20 is critical in order to get enough heat to properly set the product but to prevent too much heat which will burn the paper. Even if the timing is controlled within the critical range in order to prevent burning or scorching, a further problem is encountered when the converter assembly 10 is shut down for coffee breaks, lunch hour, or breakdowns. During those down periods, the heat-setting tube 20 will be completely filled with the paper products in sequential fashion. For example, in the case of actual machines in production for producing nested groups of coffee filters, such a tube holds fourteen groups of filter papers. Because of the nature of the heated air and the electric resistance heaters, all of these fourteen groups of filters are destroyed by burning or scorching during the period when the converter assembly 10 is being shut down.

Another related problem to this prior art apparatus is that paper or other flammable material around the working area can accidentally get inside a wire mesh guard covering the heat-setting tube 20. In such case, the paper or other flammable material can be ignited by the electric resistance heaters 34 and start a fire.

A PREFERRED EMBODIMENT OF THE INVENTION

Figure 2:
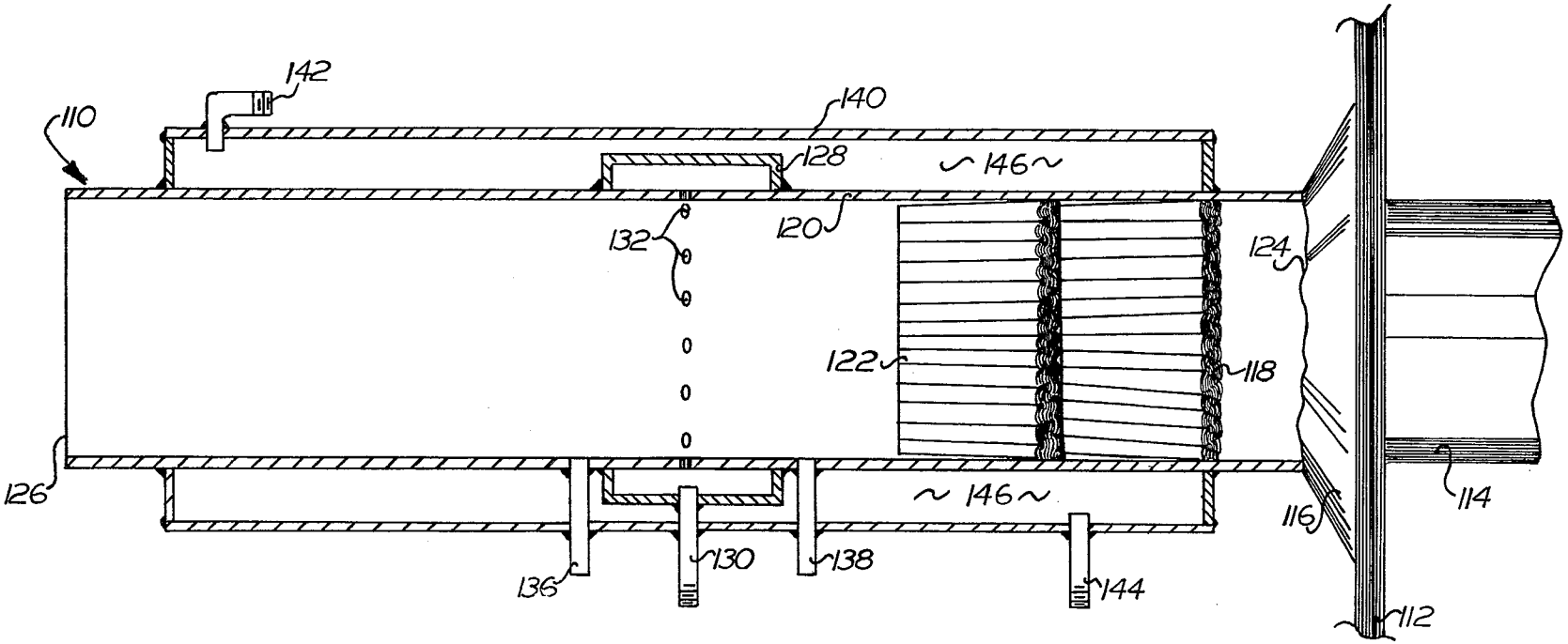
FIG. 2 is a similar view showing the apparatus of the present invention, also for forming a group of nested filters.

The above problems and disadvantages can be avoided or minimized by using the method and apparatus of the present invention shown in FIG. 2.

The mechanical operation of converter assembly 110 is similar to that described above with regard to the prior art apparatus of FIG. 1. Thus, multi-layered paper sheet stock 112, which is continuously supplied from a series of parallel feed supply rolls not shown in the accompanying drawings, is positioned between a suitable plunger 114 and a suitable die 116 for simultaneously blanking and forming a group of nested shaped paper products. The continuous sheet stock could be substituted with a series of smaller rectangular sheet stocks in one or more layers, or in the event that the necessary flat paper blanks were to be precut, only forming the blanks to the desired shape to fit into tube 120 would be necessary. The group of nested shaped paper products 118 is confined within heat-setting tube 120 throughout the length of the tube 120 from its inlet 124 to its outlet 126 for the purposes of a heat treatment to set the product into its final form. Each group of nested paper products is preceded by a prior group of paper products 122.

The multi-layered paper sheet stock blank 112 may comprise, for example, 25 layers of paper sheets if the paper supplied is dry. However, the number of layers may be increased depending upon the size and weight of the paper to a greater number, such as 50, if a wetting and lubricating spray is applied to the paper prior to passage between plunger 114 and die 116. Such a spray can, for example, be a silicone spray solution.

However, the apparatus of the present invention does not employ electric resistance heaters or heated air. Instead, steam, preferably superheated steam, is supplied for heating the paper products in two fashions. First, steam is supplied through supply tube 130 into a steam manifold 128 located centrally around the outer periphery of the heat-setting tube 120. The steam then passes from the interior of the steam manifold 128 through a series of holes 132 into the interior of the heat-setting tube 120. Return of condensation and/or steam is accomplished from the interior of the tube 120 through return lines 136 and 138 back to the source of the steam or to disposal.

Second, steam is supplied to steam tube 140 which surrounds the entire outer periphery of the heat-setting tube 120 for substantially its entire length. The steam tube is in the shape of an annular ring about the periphery of the heat-setting tube 120, but it will be appreciated that the circular shape is chosen in order to produce the desired form of circular products such as coffee filters. However, various shapes of paper products can be produced with the apparatus and the method of the present invention merely by modifying the shape of the heat-setting tube 120, die 116 and plunger 114. Accordingly, the steam manifold 128 and the steam tube 140 would be modified to accommodate the particular outer periphery of the heat-setting tube 120 that is chosen.

It is preferred to use superheated steam in both manifold 128 and steam tube 140. While various regular and superheated steam pressures and temperatures can be employed in the present invention, superheated steam at about atmospheric pressure, approximately 15 p.s.i.a., with a temperature above about 212° F is preferred.

Steam tube 140 is shown as one continuous steam jacket, but it will be appreciated that such a construction was made for simplification of the fabrication process and steam supply requirements. Other modifications would be suitable, such as the use of two steam tubes about either side of the steam manifold 128.

Steam is supplied to the steam tube 140 by means of a supply line 142. The steam within the interior 146 of the steam tube 140 transmits heat to the heat-setting tube 120 which in turn heats the representative paper products 118 and 122 within the tube 120 along with the steam supplied through the steam manifold 128 into the interior of the tube. Steam from the interior 146 of the steam tube 140 can be circulated back to the source of the steam along with any condensation through return line 144; depending on whether steam or preferably superheated steam is employed and the resident time of the steam within steam tube 140 and steam manifold 128, water returning through lines 136, 138 and 144 will be either in the form of a liquid, vapor, or a combination of both, and accordingly, may be returned to the steam generator or disposal. Minimization of the condensate in the return lines is preferred.

Shaped paper products can be produced in accordance with the method and apparatus of the present invention singly or in nested groups depending upon the number of layers of paper in the paper sheet stock 112 which are fed from the supply rolls. The term "paper" is used in the sense that the sheet material can be any fibrous, cellulosic material. Also included within this term are equivalent heat-settable materials whether natural or synthetic.

An advantage of the present invention lies in the elimination of the dangerous 440 volt electric resistance heaters discussed above. Since those heaters are eliminated, blowouts and fire hazards because of the heaters are also eliminated which results in greater protection for the workers, increased process and apparatus efficiency and lower unit cost for the products.

The steam supplied by means of steam manifold 128 into the interior of the heat-setting tube 120 acts as a lubricant and a protector of the paper products within the heat-setting tube 120. That result together with the nature of steam as supplied to the steam tube 140 results in a process and apparatus in which the filters within the heat-setting tube 120 do not normally burn or scorch regardless of how long they remain within the heat-setting tubes 120. Thus, during the lunch hour, coffee breaks, or machine breakdowns, the paper products within the heat-setting tube 120 are not destroyed as is the case with the prior art apparatus.

Also, if paper accidentally gets inside the protective wire mesh guard surrounding the steam tube 140, the paper will not burn as it does in connection with the prior art apparatus.

In addition to the foregoing, the present invention saves the cost of replacing resistance electric heaters in blowouts and fires and the cost of maintenance of the apparatus is materially reduced.

What is claimed is:

1. In a method of continuously producing a dish-shaped filter by forming multi-layered paper sheet stock into nested groups of the desired dish-shaped filter, forcing the nested groups of the dish-shaped filter through a heat-setting tube in sequential fashion so that a plurality of nested groups of the dish-shaped filter are simultaneously present in said heat-setting tube, and simultaneously heating the plurality of nested groups of the dish-shaped filter being forced through said heat-setting tube sufficiently to maintain its shape upon removal from the heatsetting tube, the improvement whereby the heating is performed with minimized burning or scorching of the nested groups of the dish-shaped filter by supplying steam into the interior of the heat-setting tube to act as a lubricant and protector of the nested groups of the dish-shaped filter and into a steam tube surrounding the heat-setting tube, said steam tube surrounding said heat-setting tube extending for substantially the whole length of the heat-setting tube and containing supply and return lines for circulation of the steam through the steam tube.

2. A method as claimed in claim 1 wherein the steam employed is superheated steam.

3. A method as claimed in claim 1 wherein the steam supplied to the interior of the heat-setting tube is supplied through a steam manifold surrounding the central portion of the outer periphery of the heat-setting tube, said heatsetting tube having holes in the outer periphery thereof for communication with the steam manifold and having a return line leading from the interior of the heat-setting tube so that steam can be circulated through the steam manifold into the interior of the heat-setting tube.

* * * * *